US006434755B1

(12) United States Patent
Halstead et al.

(10) Patent No.: US 6,434,755 B1
(45) Date of Patent: Aug. 20, 2002

(54) HELMET

(75) Inventors: P. David Halstead; Cherie F. Alexander; Thad Ide, all of Knoxville, TN (US)

(73) Assignee: Southern Impact Research Center, LLC, Knoxville, TN (US)

( * ) Notice: Subject to any disclaimer, the term of this patent is extended or adjusted under 35 U.S.C. 154(b) by 0 days.

(21) Appl. No.: 09/586,124

(22) Filed: Jun. 2, 2000

Related U.S. Application Data

(63) Continuation-in-part of application No. 09/325,827, filed on Jun. 4, 1999, now Pat. No. 6,219,850.

(51) Int. Cl.[7] ..... A42B 3/00
(52) U.S. Cl. ..... 2/414; 2/425; 2/413
(58) Field of Search ..... 2/411, 412, 413, 2/414, 417, 418, 419, 425, DIG. 3

(56) References Cited

U.S. PATENT DOCUMENTS

| | | | | |
|---|---|---|---|---|
| 2,296,335 | A | | 9/1942 | Brady |
| 2,634,415 | A | * | 4/1953 | Turner et al. |
| 3,568,210 | A | | 3/1971 | Marietta |
| 4,060,855 | A | | 12/1977 | Rappleyea |
| 4,239,106 | A | * | 12/1980 | Aileo |
| 4,345,338 | A | | 8/1982 | Frieder, Jr. et al. |
| 4,534,068 | A | | 8/1985 | Mitchell et al. |
| 4,558,470 | A | | 12/1985 | Mitchell et al. |
| 4,627,114 | A | | 12/1986 | Mitchell |
| 4,808,469 | A | | 2/1989 | Hiles |
| 4,845,786 | A | | 7/1989 | Chiarella |
| 5,010,598 | A | * | 4/1991 | Flynn et al. |
| 5,035,009 | A | | 7/1991 | Wingo et al. |
| 5,361,410 | A | | 11/1994 | Sigl |
| 5,734,994 | A | | 4/1998 | Rogers |
| 5,862,528 | A | | 1/1999 | Saijo et al. |
| 5,867,840 | A | | 2/1999 | Hirosawa et al. |
| 5,940,890 | A | | 8/1999 | Dallas et al. |
| 5,950,244 | A | | 9/1999 | Fournier et al. |

OTHER PUBLICATIONS

Red football helmet having "Adams" written on frontal pad, photographs of which are labeled Exhibit A. Helmets corresponding to the helmet shown in Exhibit A were available to the public more than one year before Jun. 4, 1999.
White football helmet having "Air" written on frontal pad, photographs of which are labeled Exhibit B. Helmets corresponding to the helmet shown in Exhibit B were available to the public more than one year before Jun. 4, 1999.
Purple football helmet having "Riddell" written on frontal pad, photographs of which are labeled Exhibit C. Helmets corresponding to the helmet shown in Exhibit C were available to the public more than one year before Jun. 4, 1999.

* cited by examiner

*Primary Examiner*—Rodney M. Lindsey
(74) *Attorney, Agent, or Firm*—Luedeka, Neely & Graham, PC

(57) ABSTRACT

A helmet which includes a substantially rigid shell having a shell thickness defined by a substantially continuous exterior surface spaced apart from a substantially continuous interior surface. A one-piece first shock attenuating member is positioned adjacent to and in substantially in contact with portions of the interior surface of the shell. The first shock attenuating member has a first thickness and a first compression deflection. A plurality of discrete second shock attenuating members are positioned adjacent to portions of the first shock attenuating member and adjacent to and in substantially in contact with portions of the interior surface of the shell. Each second shock attenuating member has a second thickness and a second density, with the second thickness being greater than the first thickness and the second compression deflection being less than the first compression deflection.

11 Claims, 10 Drawing Sheets

HELMET

CROSS-REFERENCE TO RELATED APPLICATION

This is a continuation-in-part application of pending U.S. application Ser. No. 09/325,827, filed Jun. 4, 1999, and entitled HELMET and now U.S. Pat. No. 6,219,850.

FIELD OF THE INVENTION

This invention relates generally to helmets and more particularly to football helmets of improved construction.

BACKGROUND AND SUMMARY OF THE INVENTION

Helmets, such as football helmets often include a high impact polymer shell and a shock absorbing component interior the shell. Conventional helmets desire improvement in that they are heavy and generally uncomfortable.

The present invention relates to an improved helmet construction that provides a helmet suitable for use as a football helmet and having reduced weight and improved comfort characteristics as compared to conventional football helmets.

Accordingly, it is an object of the invention to provide an improved helmet.

Another object of the invention is to provide a helmet of the character described that weighs less than conventional helmets.

An additional object of the invention is to provide a helmet of the character described that has improved comfort aspects.

A further object of the invention is to provide a helmet of the character described that avoids many of the shortcomings of conventional helmets.

A further object of the invention is to provide a helmet of the character described that is economical to produce and convenient to use.

With regard to the foregoing, the present invention is directed to a helmet which, in a preferred embodiment, includes a substantially rigid shell having a shell thickness defined by a substantially continuous exterior surface spaced apart from a substantially continuous interior surface. A one-piece first shock attenuating member is positioned adjacent to and in substantially in contact with portions of the interior surface of the shell. The first shock attenuating member has a first thickness and a first compression deflection.

A plurality of discrete second shock attenuating members are positioned adjacent to portions of the first shock attenuating member and adjacent to and substantially in contact with portions of the interior surface of the shell. Each second shock attenuating member has a second thickness and a second compression deflection, with the second thickness being greater than the first thickness and the second compression deflection being less than the first compression deflection.

In another aspect, the invention relates to a helmet having a shell including a rear portion and opposite side portions. An offset defined on a substantially continuous portion of the shell extends between the rear and opposite side portions for increasing the flexural resistance of the shell.

In a preferred embodiment, the football helmet includes a substantially rigid shell made of a polycarbonate material and having a shell thickness of from about 0.08 to about 0.1 inches defined by a substantially continuous exterior surface spaced apart from a substantially continuous inner surface. An offset having a thickness substantially corresponding to the thickness of the shell and defined on a substantially continuous portion of the shell extends between rear and opposite side portions of the shell for increasing the flexural resistance of the shell.

A one-piece first shock attenuating member is positioned adjacent to and in substantially in contact with portions of the interior surface of the shell. The first shock attenuating member has a thickness of from about ½ to about 1 inch, a compression deflection of from about 18 to about 80 lbs./in$^2$, and a compression set of less than about 10 percent; and A plurality of discrete second shock attenuating members are positioned adjacent to portions of the first shock attenuating member and adjacent to and in substantially in contact with portions of the interior surface of the shell. Each second shock attenuating member has a second thickness and a second compression deflection, with the second thickness being from about ⅝ inch to about 1 ⅛ inch and greater than the first thickness, the second compression deflection being from about 8 to about 30 lbs./in$^2$ and less than the first compression deflection, and a compression set of less than about 10 percent.

The invention advantageously enables the manufacture of helmets that are of lighter weight than conventional helmets. This enables reduced weight and use of materials and provides helmets that avoid many of the shortcomings of conventional helmets.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
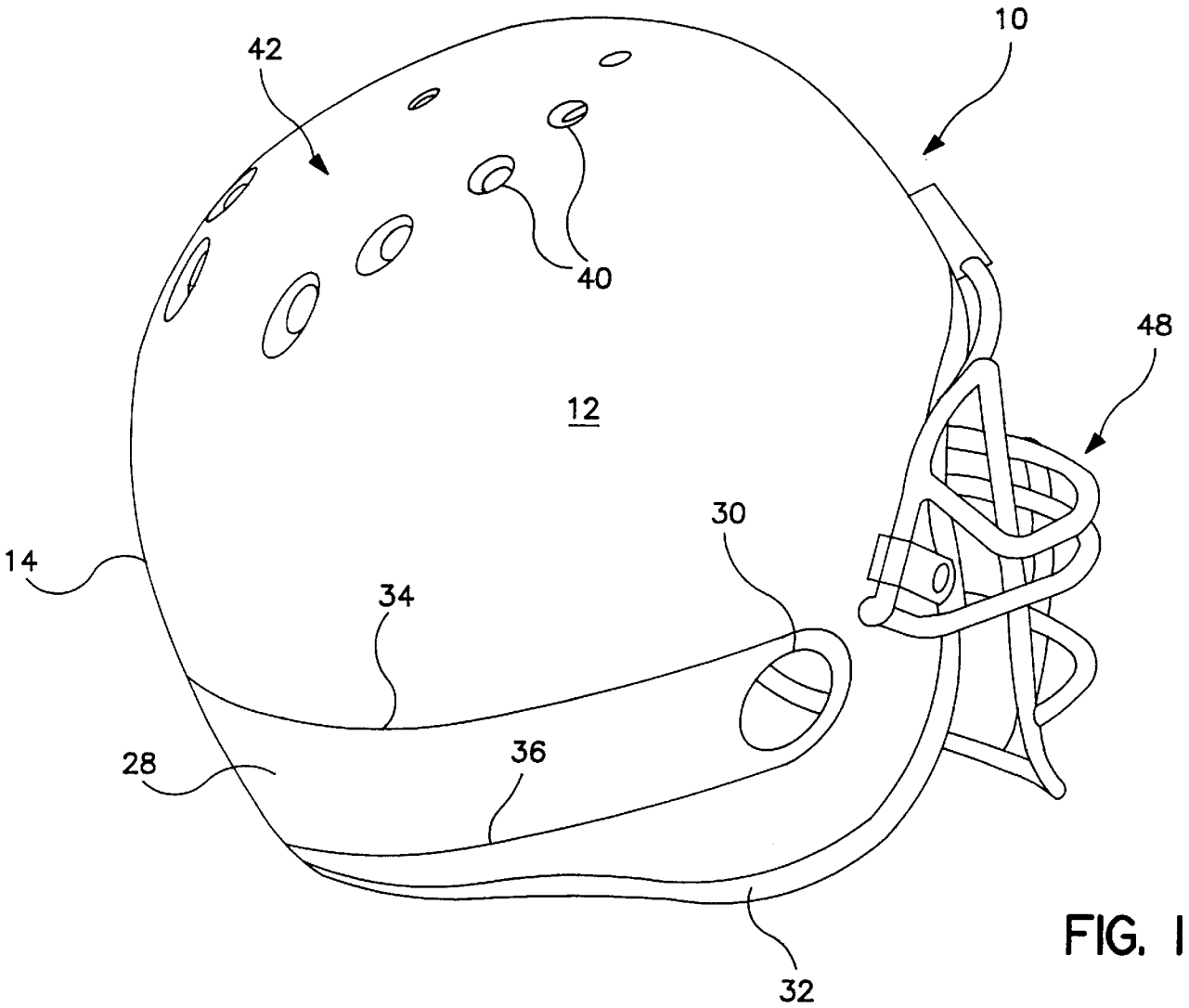
FIGS. 1 and 1*a* are side perspective views of a helmet in accordance with a preferred embodiment of the invention.
Figure 1A:
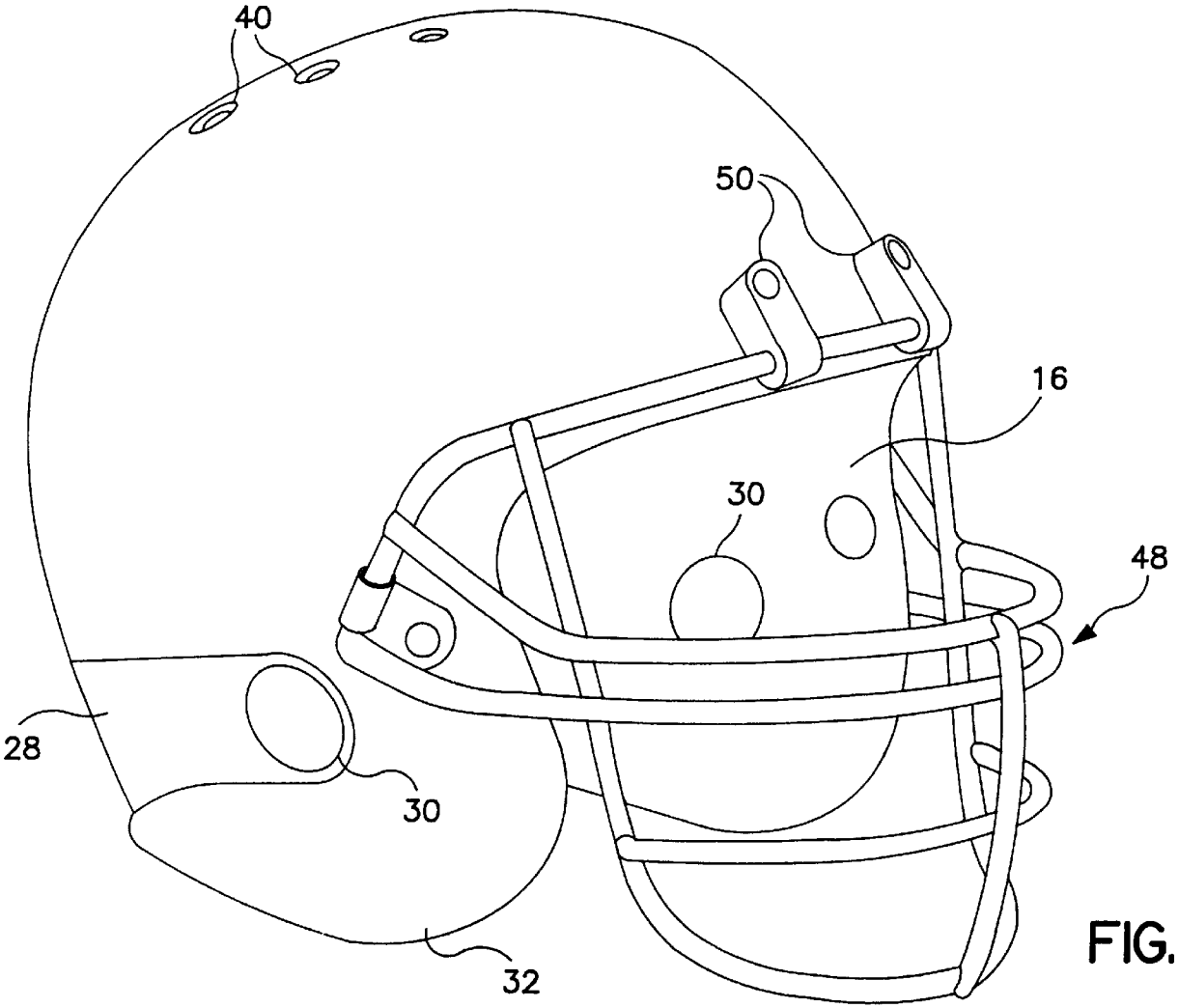
Figure 2:
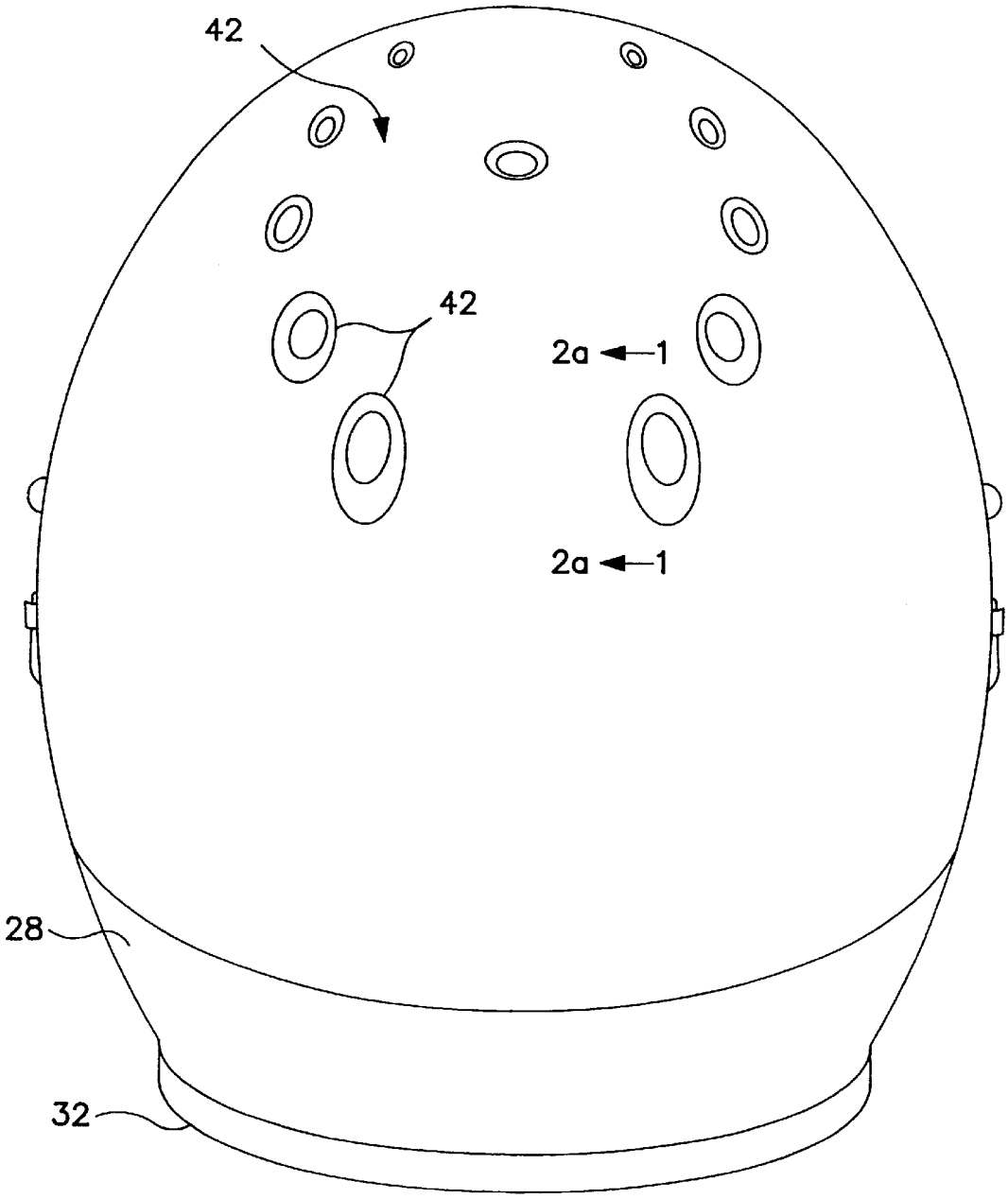
FIG. 2 is a rear perspective view of the helmet of FIG. 1.
Figure 2A:
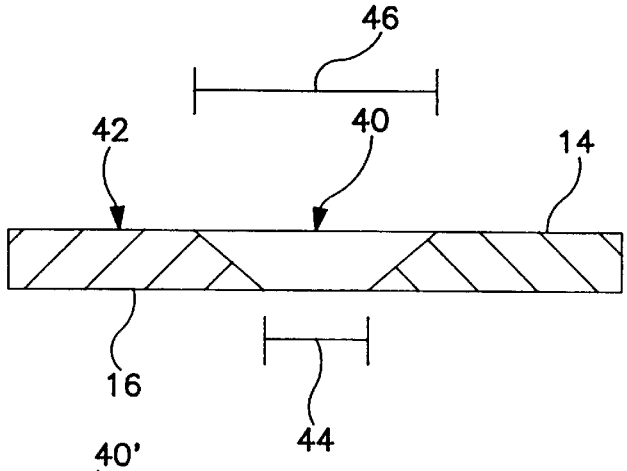
FIG. 2*a* is an enlarged cross-sectional view of one of an aperture taken along line 2*a*—2*a*.

With initial reference to FIGS. 1–2, there is shown a helmet 10 including a substantially rigid shell 12 having a shell thickness defined between a substantially continuous exterior surface 14 spaced apart from a substantially continuous interior surface 16.

Figure 4:
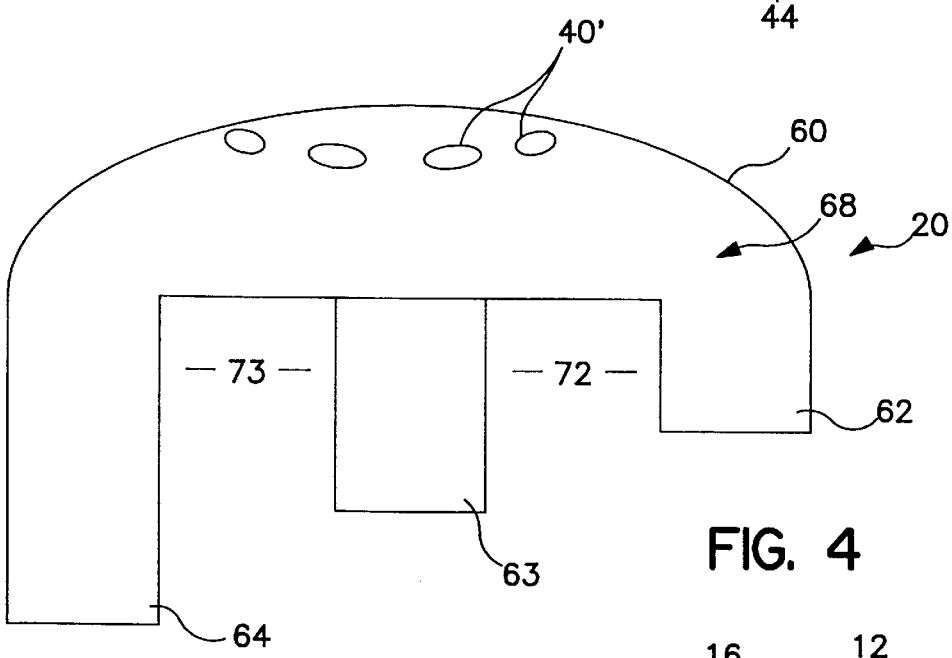
FIG. 4. is a side plan view of the component of FIG. 3.
Figure 5A:
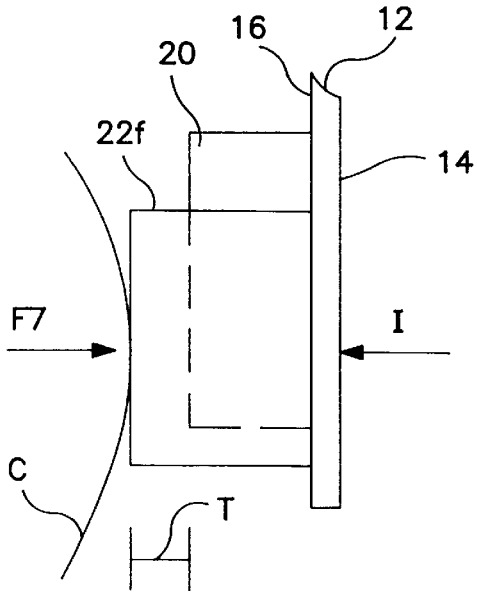
FIG. 5*a* is an enlarged representational view showing interaction between the shock attenuating components.
Figure 3:
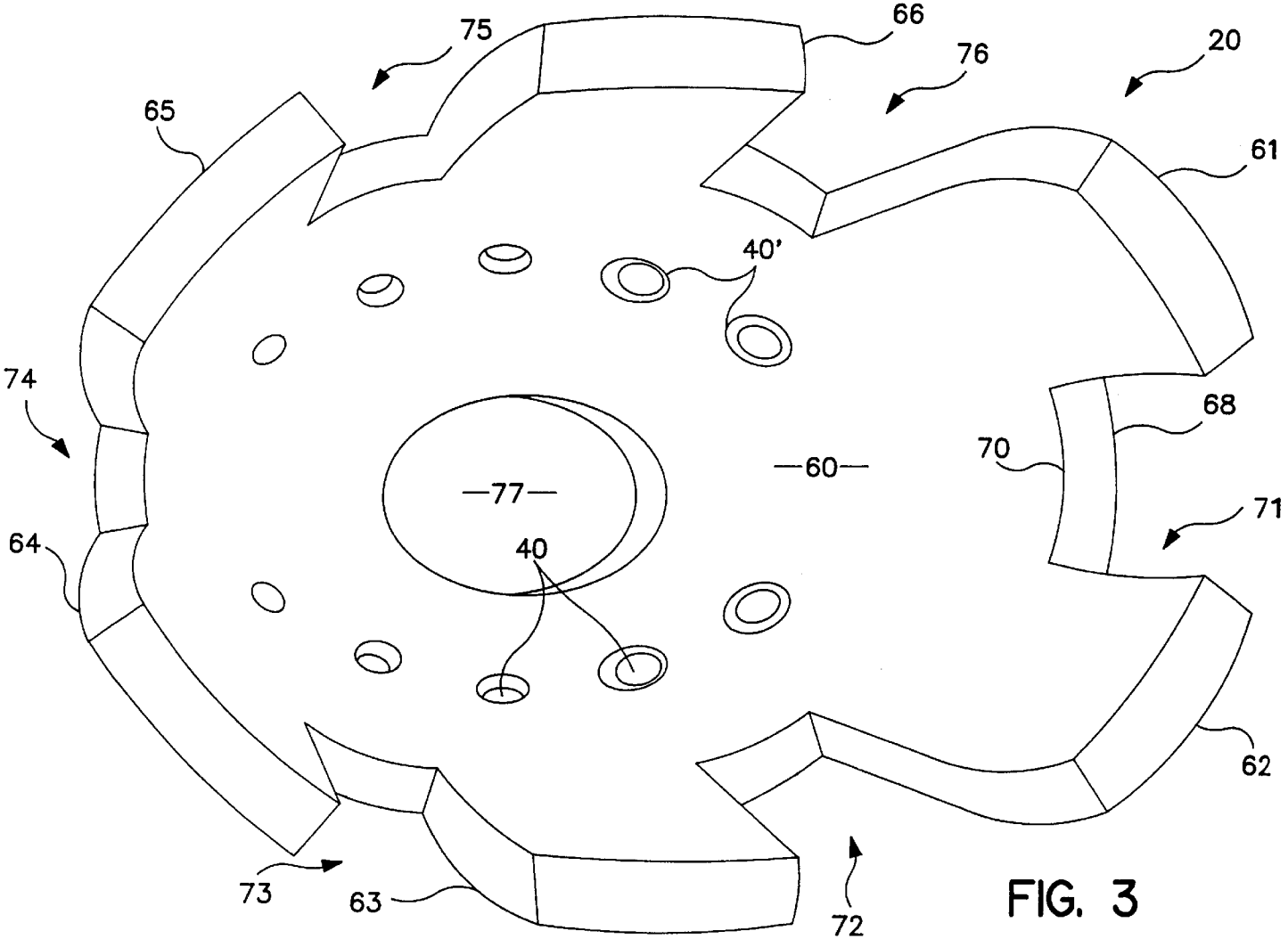
FIG. 3 is a bottom plan view showing a shock attenuating component for use in helmets according to the invention.
Figure 5:
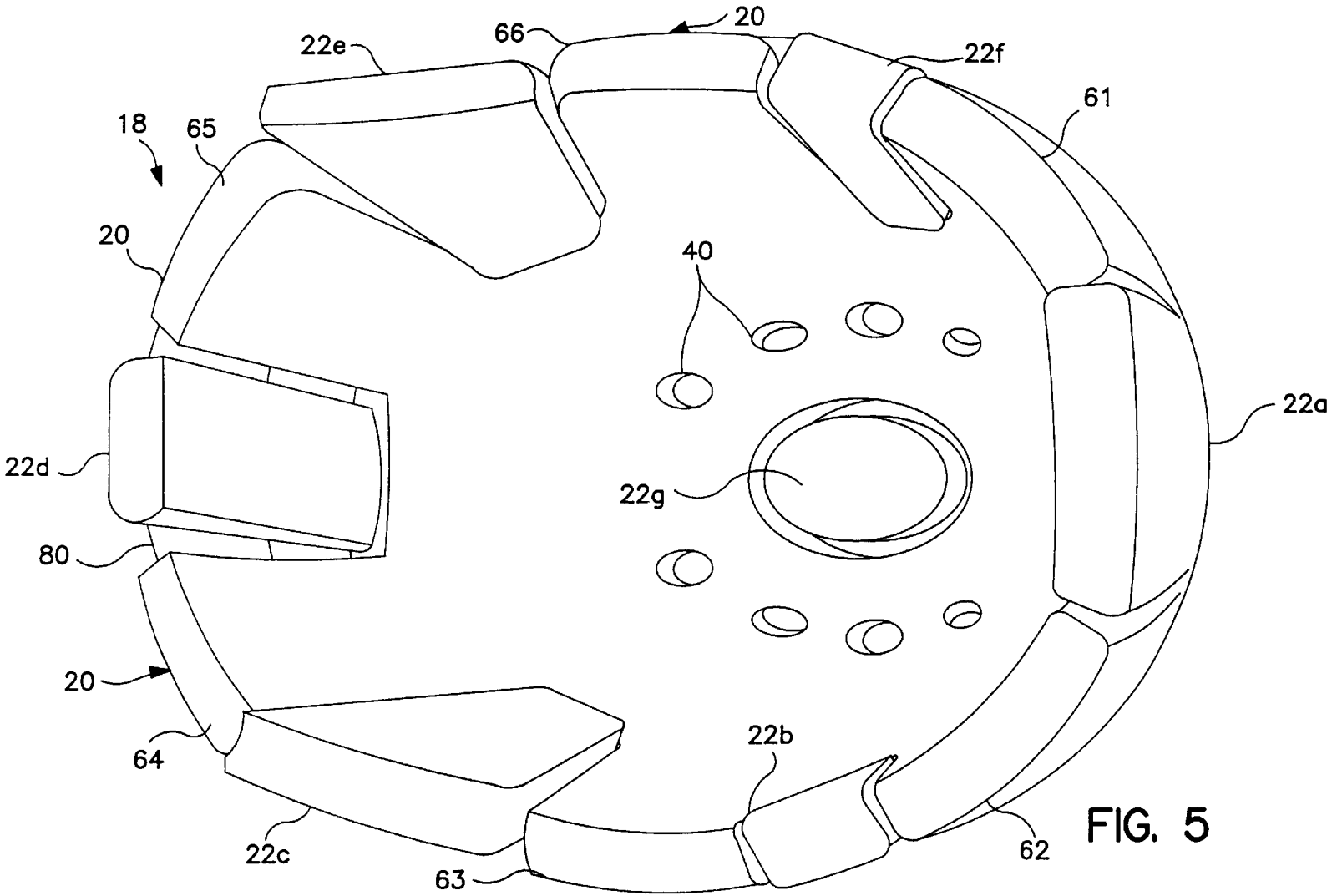
FIG. 5 is a bottom plan view showing the component of FIG. 3 and additional shock attenuating components installed for use in helmets according to the invention.

With reference to FIGS. 3–5, the interior of the helmet 10 includes a shock attenuating system 18 having a substantially rigid one-piece shock attenuating member 20 and a plurality of non-rigid shock attenuating members 22*a*–22*g*.

Figure 6:
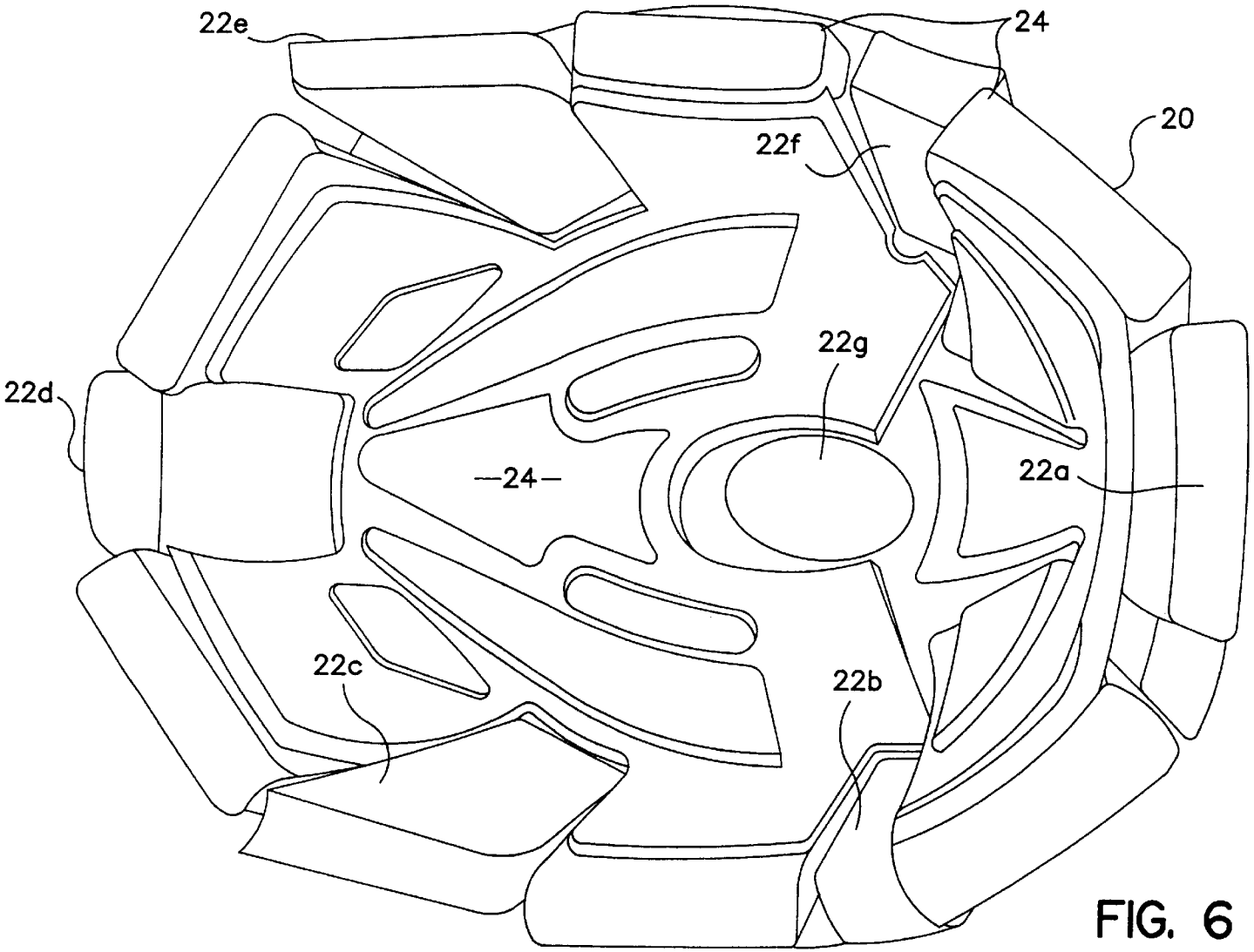
FIG. 6 is a bottom plan view showing the components of FIGS. 3 and 5 and an additional component assembled for use in helmets according to the invention.
Figure 7:
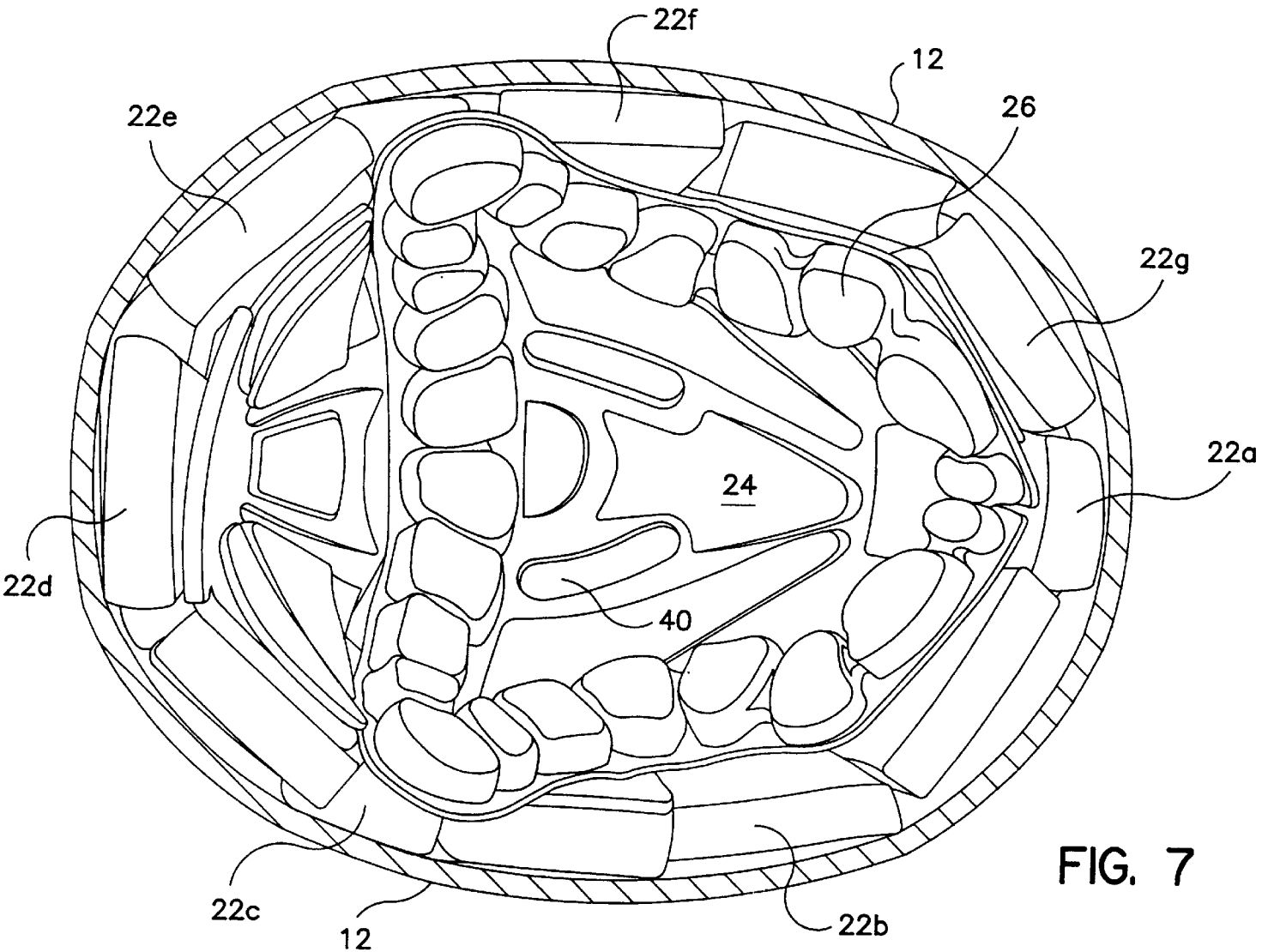
FIG. 7 is a bottom plan view showing the components of FIGS. 3, 5 and 6 and a fit component assembled for use in helmets according to the invention.
Figure 8:
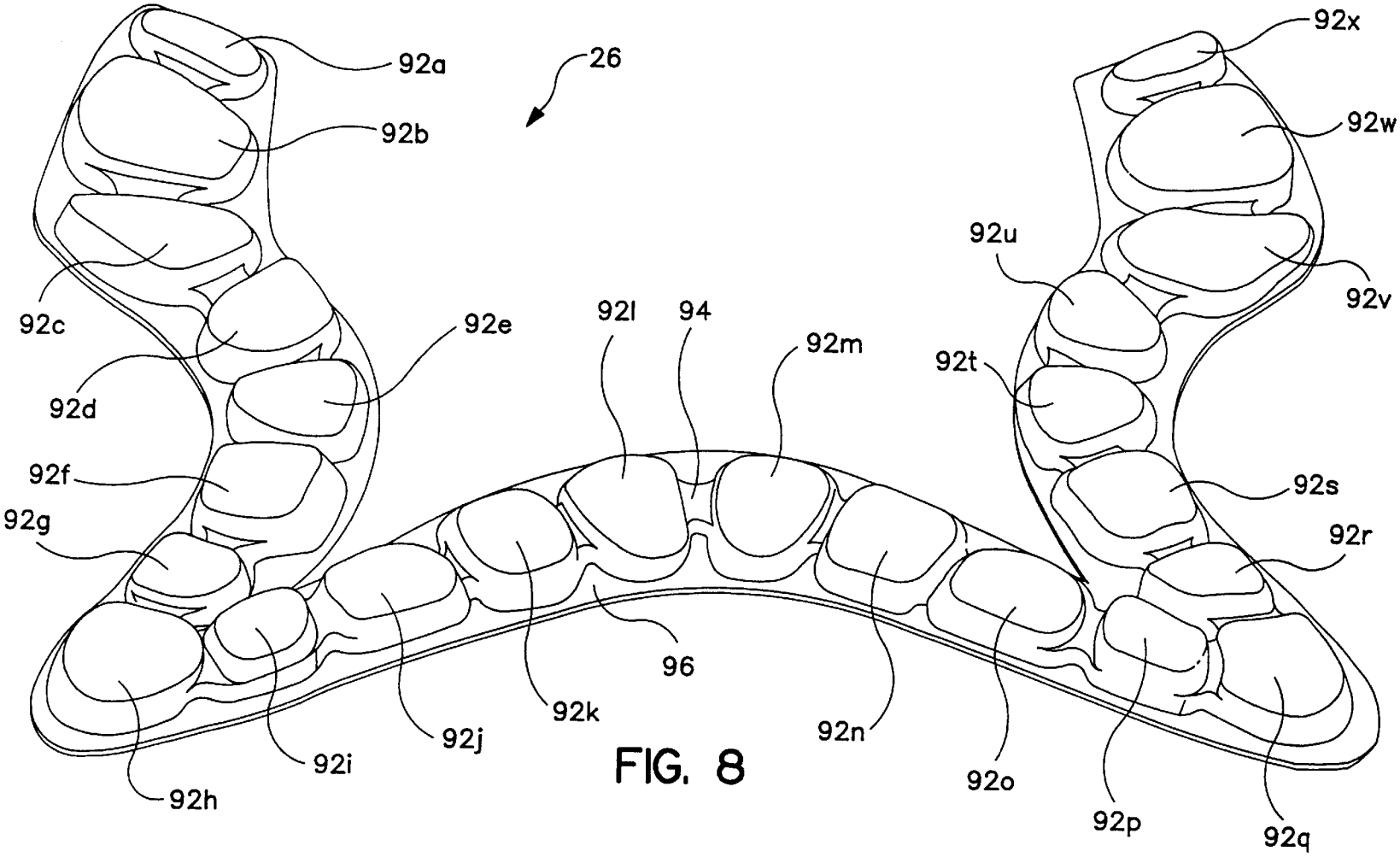
FIG. 8 is a perspective view showing a fit component for use in helmets according to the invention.

As shown in FIGS. 6–8, the helmet 10 also preferably includes a pliable comfort member 24 positioned adjacent the rigid shock attenuating member and a fit system 26 (or 26') for improving the fit of the helmet to a cranium of a user.

Shell 12

The shell 12 is preferably made of a polycarbonate alloy or a polymeric material of the type commonly used in the manufacture of football helmets and molded using a non-collapsible core. The shell 12 includes an elongate offset 28 on the exterior surface 14 that extends around the rear of the helmet and between ear holes 30 of the helmet. The offset 28 defines an exterior surface that lies in a plane below the exterior surface 14 and an interior surface that lies in a plane below the interior surface 16. The offset 28 preferably is from about 0.125 to about 0.375 inches below the surface 14, most preferably about 0.2 inches. The thickness of the offset 28 is preferably substantially the same as the thickness defined between the surface 14 and 16.

Conventionally, a desired flexural resistance is provided to a shell by making the shell sufficiently thick. However, the thickness normally required increases the weight of the shell and makes the shell sufficiently heavy so as to be uncomfortable to the wearer. The offset 28 functions to rigidify and increase the flexural resistance of the shell 12. Thus, the shell 12 incorporating the offset 28 may have a reduced thickness as compared to conventional helmet shells without compromising flexural resistance properties of the shell. This advantageously enables reductions in weight and materials. A lip 32 may also preferably provided at the exposed edge of the shell for increasing the flexural resistance of the shell.

As will be explained more filly below, integration of the shell 12 and the shock attenuating system 18 enables even further advantages including additional shell thickness reductions without detrimentally affecting the flexural resistance of the shell.

The width or height of the offset 28 preferably has an upper latitudinal line 34 located proximate the portion of the shell adjacent the occipital protuberance of the cranium of the user and a lower latitudinal line 36 just above the lip 32. The width or height defined between the upper and lower latitudinal lines is preferably from about 1 to about 4 inches, most preferably from about 2 to 3 inches. The length of the offset preferably extends the circumferential distance between the ear holes 30, with the length preferably being at least as long as the circumferential distance of the portion of the shell adjacent the occipital protuberance of the user.

The shell 12 also preferably includes a plurality of apertures 40 located along an upper portion 42 of the shell 12 and extending between the exterior surface 14 and the interior surface 16 for ventilation purposes. Each aperture 40 has an interior major axis 44 adjacent the interior surface 16 of the shell 12 that is less than its exterior major axis 46 adjacent the exterior surface 14 of the shell. The exterior major axis 46 is selected to be sufficiently small as to inhibit insertion of a human finger therein yet sufficiently large so as to avoid plugging with soil or turf when the exterior surface 14 of the shell comes into contact with a grassy or dirt playing surface, such as when the wearer of the helmet is tackled while playing football. The helmet is also preferably equipped with a suitable face guard 48 mounted to the shell using brackets 50 in a manner well known in the art.

Shock Attenuating System 18

As noted above, the shock attenuating system 18 includes shock attenuating member 20 and shock attenuating members 22*a*–22*g*. Returning to FIGS. 3 and 4, the shock attenuating member 20 is preferably of one-piece, molded construction and made of a lightweight, rigid shock attenuating material such as expanded polymer materials having shock dampening and relatively quick shape recovery characteristics. A preferred material is expanded polypropylene having a density of from about 4 to about 9 lbs./ft$^3$. Expanded polypropylene is flexible and exhibits very little compression set. That is, when exposed to a deforming force, the material rebounds or returns relatively quickly to its original size and shape. The member 20 is preferably of substantially uniform thickness, ranging from about ½ to about 1 inch, most preferably about ¾ inch (nominal). The rate of recovery is expressed as the "compression deflection," with the higher the value the faster the recovery.

The expanded polypropylene preferably exhibits a compression deflection of from about 18 to about 80 lbs./in$^2$, most preferably about 20 to about 30 lbs./in$^2$, and a compression set (when exposed to 25% compression) of less than about 10 percent, most preferably about zero. Compression deflection and compression set are each determined in accordance with ASTM-D 1292.

The members 22*a*–*g* are preferably made of a readily deformable and non-rigid material that is elastic and substantially returns to its original size and shape, but having a slower recovery time (a lower compression deflection) as compared to the material of the member 20. A preferred material for the members 22*a*–22*g* is a vinyl nitrile material having a density of from about 4 to about 12 lbs./ft$^3$, most preferably about 6 lbs./ft$^3$, a compression deflection of from about 8 to about 30 lbs./in$^2$, most preferably about 12 to about 18 lbs./in$^2$, and a compression set of less than about 10 percent, preferably about zero. The members 22*a*–22*g* are preferably of a substantially uniform thickness that is less than that of the member 20 and ranging from about ⅝ to about 1 ⅛ inch, most preferably about ⅞ inch.

The member 20 includes a substantially concave or bowl-shaped body portion 60 and a plurality of spaced apart legs 61,62,63,64,65 and 66 extending from the body portion. The member 20 is configured for placement in an overlying relationship with the cranium of a user, with the body portion 60 overlying an upper portion of the cranium and the legs 61–66 adjacent the sides, temple areas and rear of the cranium.

A plurality of apertures 40' located along an upper portion of the body portion and corresponding to the apertures 40 extend between outer surface 68 and inner surface 70 of the member 20. The apertures 40' preferably have exterior and interior major axis of substantially equal size and corresponding in dimension to the dimension of the interior major axis 44. Open area 71 between the legs 61 and 62 is configured for positioning of the member 22*a*. Similarly, open areas 72, 73, 74, 75 and 76 are configured for positioning of members 22*b*–*f*, respectively. Open area 77 adjacent a central, uppermost portion of the body portion 60 is configured for positioning of member 22*g*. As will be appreciated, the members 22*a*–22*g* substantially correspond in shape to the respective open areas, with the members

22*a*–22*f* being substantially rectangular and the member 22*g* being substantially oval in cross section.

The member 20 functions as a skeleton and has advantageous flexural resistance properties. That is, it is substantially rigid and enhances the flexural resistance of the shell when installed therein such that the shell may be made thinner when the member 20 is incorporated. The member 20 bolsters the flexural resistance of the shell such that the combination provided by the thinner shell and the member 20 can have a flexural resistance corresponding to that of a thicker shell not having the member 20.

Accordingly, inclusion of the member 20 in the helmet in accordance with the invention enables further reductions in the thickness of the shell and associated savings of weight and material. As mentioned above, the offset 28 can be incorporated into a shell to add flexural resistance so that a thinner shell can be made without compromising its flexural resistance. Thus, incorporation of both the offset 28 and the member 20 enables even further reductions in shell thickness. For example, it has been observed that a shell in accordance with the invention for football use can have a thickness of from about 0.08 to about 0.1 inches, preferably about 0.095 inches, whereas a conventional helmet typically has a thickness of at least about 0.16 inches. It has been observed that helmets in accordance with the invention may achieve weight savings of about half.

The member 20 and the members 22*a*–22*g* are positionable adjacent to and in substantially in contact with the interior surface 16 of the shell 12. The members 20 and 22*a*–22*g* are preferably maintained in positional non-interference fit relationship with one another as by a surrounding strip of tape 80 or by a surrounding strip of hook or loop material, with mating loop or hook material provided on the members 20 and 22*a*–22*g*. The members 20 and 22*a*–22*g* may likewise be secured, preferably releasably secured, to the interior surface 16 of the shell 12.

The members 22*a*–22*g* are thicker than the member 20 and saturate more readily upon exposure to shock. Thus, upon exposure of the helmet to an impact, the members 22*a*–22*g* attenuates energy and compresses to the thickness of the member 20 before the member 20 attenuates shock or force from the impact. The members 22*a*–22*g* thereafter attenuate shock only to the extent that they are further compressed. However, since the member 20 does not substantially compress, the members 22*a*–22*g* do not contribute significantly to firther attenuation of shock following their initial compression to a thickness substantially corresponding to the thickness of the member 20.

For example, and with reference to FIG. 5*a,* representational member 22*f* is shown adjacent a portion of member 22, with outer surfaces of each abutting interior surface 16 of the shell 12. Upon exposure of the outer surface 14 of the shell 12 to an impact I, cranium C of the user exerts an opposite force F against the shock attenuating member 22*f*. Force F is a force sufficient to compress the member 22*f* a thickness or amount T representing the difference in thickness between the members 20 and 22*f*. Once the member 22*f* is compressed the thickness T, it no longer contributes significantly to the attenuation of shock resulting from the impact I. That is, once the member 22*f* compresses an amount T, member 20 is exposed to the force and begins attenuating the force. Since the member 20 is considerably more difficult to compress than the member 22*f,* the member 22*f* does not significantly experience additional compression and therefore does not contribute significantly to further attenuation of shock.

Comfort Member 82 and Fit Systems 26 and 26'

A comfort member 24 is preferably positioned on inwardly facing surfaces of the member 20, since the texture of the member 20 is somewhat rough and may cause discomfort to a user. The member 24 is preferably of one piece construction and made of a relatively thin and soft material, such as rubber or foam. The member 24 is preferably configured to substantially overlie the member 20. Raised portions 84 may also be provided to enhance air circulation between the cranium and the comfort member 24. The comfort member 24 is sufficiently pliable such that it readily deforms and offers little shock attenuation as compared to the members 22*a*–*g* or the member 20.

The fit system 26 is also preferably included interior of the comfort member 82 for fitting the helmet to the user to reduce slippage of the helmet and for 20 comfort purposes. The fit system may be releasably secured to the interior of the helmet as by mating hook and loop material. Preferred fit systems are fit systems described in U.S. application Ser. No. 09/326,418, naming as inventors P. David Halstead and Cherie F. Alexander, filed on Jun. 4, 1999, and entitled HELMET FITTING SYSTEM, the entire disclosure of which is incorporated by reference.

The fit system 26 is preferably provided with a series of interconnected foam segments 92*a*–92*x,* with each adjacent segment being connected by a connecting portion 94. The segments 92*a*–92*x* are preferably secured, as by adhesive, to a flexible backing material 96. Another preferred fit system is a fit system 26' provided by a fluid fillable bladder having an M-shaped configuration similar to that of the fit system 26 and as described in the above-referenced patent application. The fit systems 26 and 26' likewise offer little compressive resistance and contribute only a small amount of shock attenuation.

Figure 9:
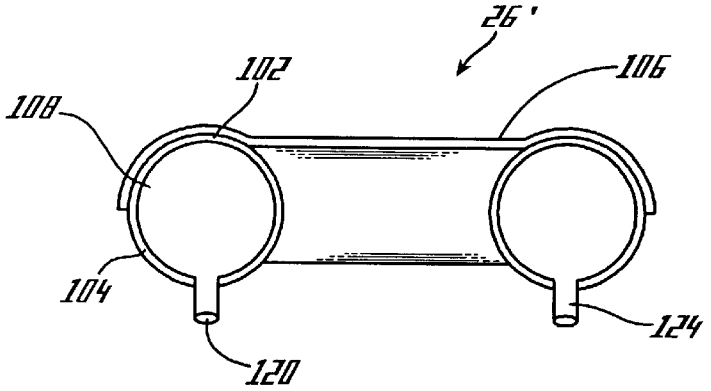
FIG. 9 shows another embodiment of a fit component which features a fluid receiving bladder.

With reference to FIG. 9, the fit system 26' preferably includes a first portion 102 of a fluid impervious material overlying a second portion 104 of a fluid impervious material. The portions 102 and 104 are preferably made of a relatively flexible and fluid impervious plastic sheet material, such as vinyl.

The first portion 102 and the second portion 104 are fixedly attached to one another to provide a substantially impervious bladder 108 therebetween for receiving a fluid. The fluid is preferably either a gas such as air, gels, liquids such as water, or curably liquids, such as liquid-based foams that cure or set into a solid form, such as polyurethane foam.

The first portion 102 preferably has a thin layer 106 of a soft material exterior to the bladder, such as nylon, velo, moleskin, or other soft, flexible fabric, secured thereto as by adhesive for contacting the cranium of the user.

An inlet port 120 is located at an inlet end 122 of the bladder 108 for introducing fluid into the bladder 108. An outlet port 124 is preferably provided at a outlet or terminal end 126 of the bladder 108 when a curable liquid fluid is to be introduced into the bladder 108 for enabling the fluid to flow out of the bladder 108 during filling. For example, a liquid foam is preferably flowed through the bladder 108 from inlet end 122 to outlet end 126 until fluid is observed to flow out of the port 124. The presence of fluid exiting the bladder through the port 124 indicates that the bladder is substantially uniformly expanded with the fluid.

In the use of non-setting fluids, e.g., gas, gels and liquids that do not change state and maintain their fluidity, the outlet port 124 is preferably not included or is provided with a seal and the inlet port 120 preferably includes a suitable valve arrangement that enables fluid to be introduced into the bladder 108 through the port and to inhibit introduced fluid from exiting the bladder 108 back through the port 120.

Figure 10:
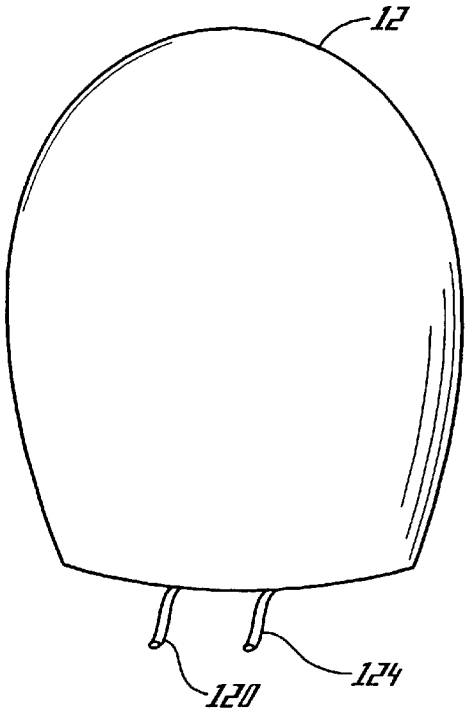
FIG. 10 shows the positioning of ports associated with the bladder of FIG. 9 relative to the shell of a helmet.
Figure 11:
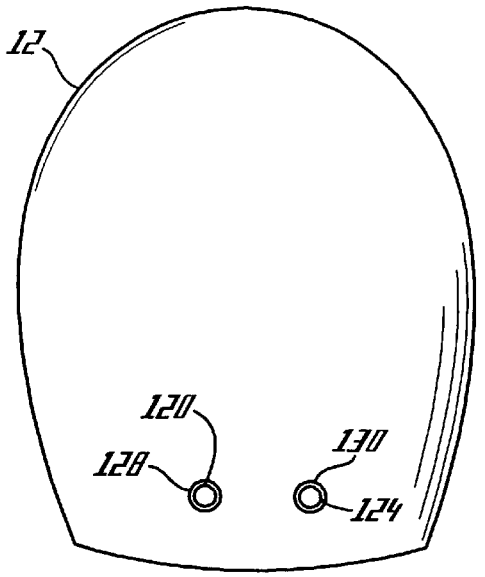
FIG. 11 shows an alternative manner of positioning ports associated with the bladder of FIG. 9 relative to the shell of a helmet.

As will readily be apparent to one of ordinary skill in the art, the ports 120 and 124 (and any valves associated therewith) may be positioned so as to be located outside of the shell of the helmet for ease of access when the helmet is worn by a user. For example, the lengths of tubing or other material used to provide the ports 120 and 124 may be of sufficient length to extend downwardly below the lower edge of the helmet (FIG. 10) or to extend through apertures 128 and 130, respectively located through the shell 12 of the helmet (FIG. 11).

The foregoing description of certain embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A helmet for wearing on a cranium of a user, the helmet comprising:

a substantially rigid shell having a shell thickness defined by a substantially continuous exterior surface spaced apart from a substantially continuous interior surface;

a substantially rigid one-piece first shock attenuating member positioned adjacent to and substantially in contact with portions of the interior surface of the shell, the first shock attenuating member having a first thickness and a first compression deflection; and a plurality of discrete second shock attenuating members, each second shock attenuating member being positioned adjacent to and having a non-interference fit with a portion of the first shock attenuating member and adjacent to and substantially in contact with portions of the interior surface of the shell, each second shock attenuating member having a second thickness and a second compression deflection, with the second thickness being greater than the first thickness and the second compression deflection being less than the first compression deflection.

2. The helmet of claim 1, wherein the first compression deflection is from about 18 to about 80 lbs./in$^2$.

3. The helmet of claim 1, wherein the second compression deflection is from about 8 to about 30 lbs./in$^2$.

4. The helmet of claim 1, wherein the first thickness is from about ½ to about 1 inch.

5. The helmet of claim 1, wherein the second thickness is from about ⅝ inch to about 1 ⅛ inch.

6. The helmet of claim 1, wherein the first shock attenuating member comprises expanded polypropylene.

7. The helmet of claim 1, wherein each of the second shock attenuating members comprises a vinyl nitrile member.

8. The helmet of claim 1, wherein the first attenuating member has inwardly facing surfaces which face generally away from the shell and toward cranial surfaces of a user's cranium when the helmet is worn by a user, the helmet further comprising a pliable comfort member having outwardly facing surfaces positioned to abut the inwardly facing surfaces of the first attenuating member and inwardly facing surfaces which face generally toward the cranial surfaces.

9. The helmet of claim 8, further comprising a fit system for improving the fit of the helmet to the cranium.

10. The helmet of claim 9, wherein the fit system is fluid-filled.

11. A helmet, comprising a shell having a rear portion and opposite side portions having ear holes and an offset defined on a substantially continuous portion of the shell extending between the rear and opposite side portions for increasing the flexural resistance of the shell, wherein the offset extends substantially between the ear holes.

* * * * *

UNITED STATES PATENT AND TRADEMARK OFFICE

CERTIFICATE OF CORRECTION

PATENT NO. : 6,434,755 B1
DATED : August 20, 2002
INVENTOR(S) : Halstead et al.

It is certified that error appears in the above-identified patent and that said Letters Patent is hereby corrected as shown below:

Column 4,
Line 31, after "ASTM-D", replace "1292" with -- 3574 --.

Signed and Sealed this

Twenty-first Day of June, 2005

JON W. DUDAS
*Director of the United States Patent and Trademark Office*